US006091286A

United States Patent [19]

Blauschild

[11] Patent Number: 6,091,286

[45] **Date of Patent: *Jul. 18, 2000**

[54] FULLY INTEGRATED REFERENCE CIRCUIT HAVING CONTROLLED TEMPERATURE DEPENDENCE

[75] Inventor: Robert A. Blauschild, Los Altos, Calif.

[73] Assignee: Philips Electronics North America Corporation, New York, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/876,827

[22] Filed: Jun. 16, 1997

Related U.S. Application Data

[63] Continuation of application No. 08/683,511, Jul. 12, 1996, abandoned, which is a continuation of application No. 08/550,186, Oct. 30, 1995, abandoned, which is a continuation of application No. 08/195,410, Feb. 14, 1994, abandoned.

[51] Int. Cl.[7] ..... G05F 1/10

[52] U.S. Cl. ..... 327/543; 327/538

[58] Field of Search ..... 327/306, 331, 327/332, 538, 539, 540, 543, 545, 546

[56] References Cited

U.S. PATENT DOCUMENTS

| | | | |
|---|---|---|---|
| 4,127,783 | 11/1978 | Alaspa | 327/538 |
| 4,577,119 | 3/1986 | Kim et al. | 327/539 |
| 4,843,265 | 6/1989 | Jiang | 307/591 |
| 4,965,510 | 10/1990 | Kriedt et al. | 327/410 |
| 5,072,136 | 12/1991 | Naghshineh | 327/539 |
| 5,086,238 | 2/1992 | Watanabe et al. | 327/410 |
| 5,087,831 | 2/1992 | Ten Eyck | 327/540 |
| 5,124,580 | 6/1992 | Matthews et al. | 327/538 |
| 5,235,218 | 8/1993 | Matsuo et al. | 327/538 |
| 5,304,862 | 4/1994 | Memida | 327/538 |

*Primary Examiner*—Terry D. Cunningham
*Attorney, Agent, or Firm*—Brian J. Wieghaus

[57] ABSTRACT

Mobility in an FET is used as a time standard to develop a resistance (or a transconductance or a current) reference which may be fully integrated and which is temperature stable to an arbitrary desired accuracy (or which varies with temperature in a desired fashion). The large temperature dependence of mobility is compensated (or adjusted to a desired variation characteristic) by applying a gate bias voltage having a predetermined variation in value with respect to temperature. In one embodiment the bias voltage of the FET is given a temperature dependence which results in the drain current of the FET being substantially constant with respect to temperature. This current is then used to charge or discharge a capacitor, yielding a precise R-C product which may be implemented fully in integrated form.

13 Claims, 7 Drawing Sheets

FULLY INTEGRATED REFERENCE CIRCUIT HAVING CONTROLLED TEMPERATURE DEPENDENCE

This is a continuation of application Ser. No. 08/683,511, filed Jul. 12, 1996, now abandoned, which is a continuation of application Ser. No. 08/550,186 filed Oct. 30, 1995 now abandoned, which is a continuation of Ser. No. 08/195,410 filed Feb. 14, 1994, now abandoned.

BACKGROUND OF THE INVENTION

1. Field of the Invention

This invention generally relates to circuits for producing reference voltages and reference currents, and to time reference circuits which use reference voltages and/or currents to create the time reference, such as oscillators, filters, time delay circuits and clocks, and more specifically relates to a reference circuit which is completely formed as an integrated circuit (i.e., having no external components) and which has either a controlled temperature dependence or substantially no dependence on temperature.

2. Related Art

It is generally desirable for integrated circuits to be fabricated entirely in integrated form (i.e., without any external components or external time references being needed), because an external connection to a component or time reference is a potential source of noise injection or other board or package parasitic problems. The external connection and component also add considerable complexity and significant cost. There are some circuits, however, such as oscillators and filters, which are inherently difficult to fabricate entirely in integrated form, because they require an accurate time constant, and accurate time constants are not readily implemented entirely in integrated form.

Time constants are typically derived from an R-C, L-C or crystal resonator time reference. Crystal resonators cannot be fabricated in an integrated circuit, so use of a crystal resonator inherently involves an external component and connection. Inductors can be fabricated in integrated form, but only in small values as a practical matter, so the use of integrated L-C circuits is limited to high-frequency applications. Internal resistors and capacitors are easy to fabricate in integrated form, but they have inaccurate values with a resulting R-C time constant tolerance in the +/− 30–60% range.

Hybrid circuits have been used to improve on the inaccuracy of integrated R-C time constants. Using an external capacitor improves the tolerance by about 10% and makes big time constants possible, but this becomes unwieldy and expensive if multiple time constants are required. The external connection is also a disadvantage, as noted above, and the inaccuracy of integrated R-C time constants is due mostly to variation of the resistance value with processing and temperature. Since integrated capacitors are usually temperature stable, combining them with an external resistor can yield a time constant accuracy in the range of 15%. It's also easy to use a single master resistor to achieve multiple time constants, but the external connection is still a significant disadvantage. A big jump in accuracy is achieved when trimmed internal resistors having a low temperature coefficient (TC) are used, but unfortunately this results in a big jump in process complexity and product cost.

Perhaps the most popular approach to timing accuracy at this time is to use an accurate external clock for driving switched capacitor circuits. Assuming the availability of such a clock, the system is made more complex by the presence of switching noise and the need for anti-alias and smoothing filters. Continuous-time filters can also be locked to an external clock, but this generally requires an additional phase locked loop (PLL) in the design. Both of these approaches also suffer from the disadvantage of requiring an external connection.

Many applications require an accuracy in timing variation in the range of 5% or better. Accordingly, there is a need for an integrated circuit design for producing a time constant having an accuracy of 5% or better without requiring any external component, clock, or trimming.

In U.S. Pat. No. 4,843,265, a temperature and processing compensated time delay circuit is described which can be fabricated in a monolithic integrated circuit. This circuit is shown in FIG. 1. A bias voltage connected to the gate of a field effect transistor (FET) $M_{12}$ is deliberately designed to have a non-linear variation with temperature which substantially matches and compensates for the variation in temperature exhibited by the mobility of the FET, so as to make the drain current of the FET have a value which is not very much dependent upon temperature. The drain current of the FET is then used to discharge a capacitor (not shown) to provide a time constant. This approach promises to achieve the high accuracy desired, but the disclosed circuit implementation still has a number of disadvantages.

The gate bias voltage is given a temperature dependence in this circuit by subtracting three negative temperature coefficient base-emitter voltages (3 $V_{be}$), generated by bipolar transistors $Q_1$, $Q_2$ and $Q_3$, from a scaled and temperature-invariant bandgap reference voltage ($V_{BG}$). The threshold voltage in FET $M_{12}$ is cancelled by level-shifting the gate bias voltage up with another FET $M_{54}$. Buffers are used to scale the bandgap reference and to provide a low impedance drive for the current source transistor $M_{12}$.

This circuit has the disadvantage that the negative temperature coefficient term cannot be arbitrarily scaled. The coefficient of 3 can be reduced to 2 or increased to 4 by deleting or adding a bipolar transistor to substract or add a base-emitter voltage ($V_{be}$), but coefficients in between cannot be selected. This either makes the compensation only approximate (i.e., still leaves a significant temperature variation) or else constrains the drain current of FET $M_{12}$ to a single predetermined value that corresponds to the number of $V_{be}$ voltages subtracted by the circuit.

Another disadvantage stems from the fact that the circuit does not assure that FET $M_{54}$ will have its source at the same potential as the source of FET $M_{12}$. If the two sources are not at the same potential, the turn on voltages at which the two FETs turn on are not the same and there will not be exact cancellation of the threshold voltage in FET $M_{12}$! The FIG. 1 circuit also is unduely complex since an operational amplifier $A_1$ is needed to scale up $V_{BG}$ and another operational amplifier $A_2$ is needed to match impedances.

Still another disadvantage is that the FIG. 1 circuit has no way of more accurately matching the temperature variation characteristic of mobility than by the 3 $V_{be}$ term. This term does not provide an exact match. Furthermore, the circuit is strictly designed for temperature compensating the drain current of an FET connected so as to discharge a capacitor. While this automatically temperature compensates the time delay produced by the capacitor being discharged, there are many other circuit configurations where the time constant will not be temperature compensated properly by the bias voltage dependence on temperature that is created by the FIG. 1 circuit.

One example of a circuit where a different temperature dependence is needed for the bias voltage is in a current source reference or a time reference that uses a current for the reference, such as a transconductance type filter. In this case, the drain current of the FET that needs to be temperature compensated is not proportional to the bias voltage, as is assumed in the FIG. 1 circuit, but instead is proportional to the bias voltage squared. An entirely different temperature dependence is needed for the bias voltage in such a circuit if the time constant is expected to be constant with respect to temperature variation.

There are also situations where it is desired to have a time reference value depend upon temperature, but where the temperature dependence characteristic of mobility in an FET is not the desired temperature dependence characteristic. It would be desirable to be able to arbitrarily tailor the temperature dependence of a time reference (or more generally the temperature dependence of a current source, or the temperature dependence of a bias voltage for an FET).

SUMMARY OF THE INVENTION

It is an object of this invention to provide an accurate time reference with an integrated circuit that requires no external components or connections other than usual supply voltages.

Another object is to provide a current reference circuit which may be fully integrated (i.e., not requiring any external component or timing signal) with a capacitor and other integrated circuit components to produce an accurate time reference.

Still another object is to provide a current reference circuit which may be fabricated as a monolithic integrated circuit and which may provide a current which has an arbitrary predetermined variation in value with respect to temperature variation.

It is a further object to provide a current reference circuit which may be fabricated as a monolithic integrated circuit and which may provide a current of arbitrary value that does not vary with respect to temperature variation.

It is also an object to provide a bias voltage for an FET which may be fabricated fully in integrated form and which exhibits an arbitrary predetermined variation in value with respect to temperature variation.

Another object is to provide a circuit that may be fabricated entirely in integrated form and which provides an accurate transconductance of arbitrary value and which does not vary with respect to temperature variation.

These and further objects and features have been achieved by using mobility in an FET as a time standard to develop a resistance (or a transconductance or a current) which is temperature stable to an arbitrary desired accuracy (or which varies with temperature in a desired fashion). The large temperature dependence of mobility is compensated (or adjusted to a desired variation characteristic) by applying a gate bias voltage having a predetermined variation in value with respect to temperature.

In one embodiment the bias voltage of the FET is given a temperature dependence which results in the drain current of the FET being substantially constant with respect to temperature when it charges or discharges a capacitor, yielding a precise R-C product.

DESCRIPTION OF THE PREFERRED EMBODIMENTS

All the embodiments use mobility in a MOS FET as a time reference. Mobility is sensitive to doping concentration and temperature. For native devices (low doping), mobility is insensitive to processing, and for typically implanted devices (eg., $1\times10^{17}$ NMOS), 10% doping change causes only a 2.6% mobility shift. The units for mobility are cm-squared per volt-seconds. Since area is invariant and voltage can be controlled by design, the remaining parameter is seconds. Control of mobility is fairly tight with standard processing. For native devices, mobility is fairly independent of doping, so there is even less variability when the time (or current or voltage) reference is made in accordance with this invention using a native FET device.

Figure 1:
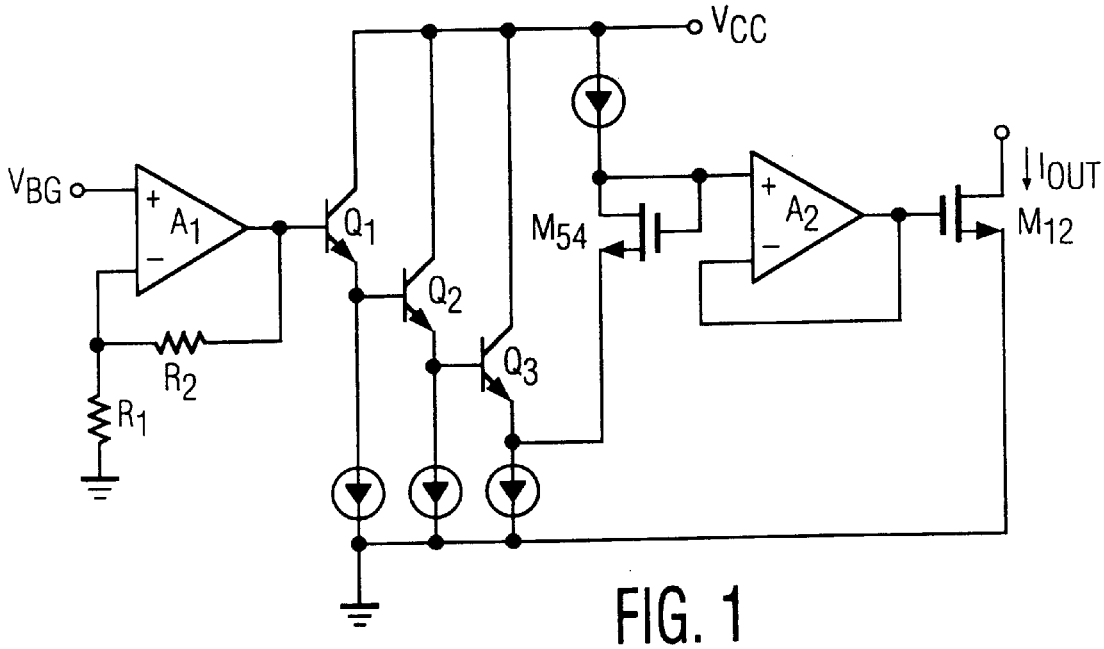
FIG. 1 PRIOR ART
FIG. 1 is a prior art circuit in which the drain current of an FET is stabilized with respect to temperature variation in order to produce a temperature stable time constant.
Figure 2:
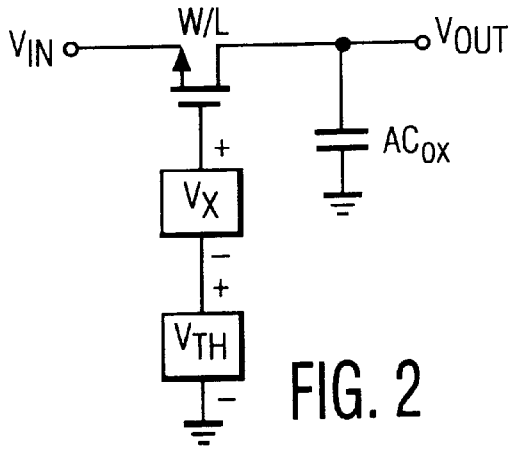
FIG. 2 is a simple R-C filter circuit in which the resistance is implemented with an MOS FET having a gate bias voltage of $V_X+V_{TH}$.

Referring now to FIG. 2, a simple single-pole, low-pass MOS FET filter is shown. Capacitance is equal to capacitor area A times $C_{OX}$, and the triode region resistance is equal to $$\frac{1}{\mu C_{OX}\left(\frac{W}{L}\right)(V_{GS}-V_{TH})}$$

where $\mu$ is mobility, $C_{OX}$ is the oxide capacitance per unit area, W is the width of the channel, L is the length of the channel, $V_{GS}$ is the gate to source voltage, and $V_{TH}$ is the threshold voltage. Therefore the R-C time constant is $$RC=\frac{1}{\mu C_{OX}\left(\frac{W}{L}\right)(V_{GS}-V_{TH})}AC_{OX}$$

which reduces to $$RC=\frac{A}{\mu\left(\frac{W}{L}\right)(V_{GS}-V_{TH})}$$

If we bias $V_{GS}$ with a voltage $V_X$ plus $V_{TH}$, as shown in FIG. 2, and substitute $V_X+V_{TH}$ for $V_{GS}$, the time constant reduces further to $$RC = \frac{A}{\mu\left(\frac{W}{L}\right)V_X}$$

Capacitor area and W/L are well defined and temperature invariant. Mobility only varies a few percent in production, but it has a large temperature coefficient, typically varying with temperature to the −3/2 power. Overall temperature invariance may be achieved by designing $V_X$ to have an amplitude that varies with temperature opposite to the temperature variation of $\mu$, namely by giving $V_X$ a temperature coefficient (tc) proportional to absolute temperature T to the +3/2 power. Scaling of the corner frequency may be done by changing capacitor area, device W/L, or the nominal value of $V_X$. Simple programming is also possible by using a single control voltage switched to the gates of different sized transistors connected in parallel. There are some disadvantages to this circuit architecture, however. Any DC voltage across the MOS FET device and/or body effect will make the on-resistance vary, so circuitry needs to be added to compensate.

Figure 3:
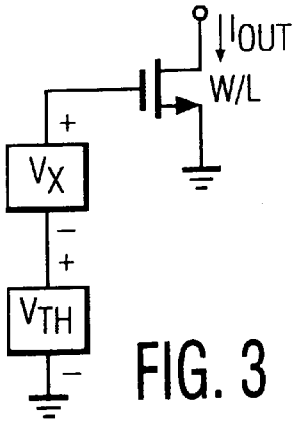
FIG. 3 shows a current source implemented by a MOS FET biased into saturation by a gate voltage $V_X+V_{TH}$.

A more practical reference may be built using a MOS FET device in saturation, as shown in FIG. 3. Assuming saturation $$I_{OUT} = \frac{\mu C_{OX}}{2}\left(\frac{W}{L}\right)V_X^2$$

An equivalent resistance may be defined as $V_X$ divided by $I_{OUT}$.

$$R_{EQ} = \frac{V_X}{I_{OUT}} = \frac{2}{\mu C_{OX}\frac{W}{L}V_X}$$

The principle is the same. As with the previous case, constant resistance is achieved by having $V_X$ vary with T to the 3/2 power. For constant current in the FIG. 3 circuit without variation due to temperature change $$\frac{dI}{dT} = \left(\frac{C_{OX}}{2}\right)\left(\frac{W}{L}\right)\left(\frac{d\mu}{dT}V_X^2 + 2\mu V_X\frac{dV_X}{dT}\right) = 0$$

This condition simplifies to $$\left(\frac{1}{V_X}\right)\frac{dV_X}{dT} = -\left(\frac{1}{2}\right)\left(\frac{1}{\mu}\right)\frac{d\mu}{dT}$$

Therefore, for constant current, $V_X$ needs to vary with T to the 3/4 power, or half of the mobility drift. This current source furthermore is proportional to $C_{OX}$, and will therefore track timing capacitor variation. This reference can also be used in applications other than timing circuits if the tolerance due to $C_{OX}$ variation is acceptable. The reference can also be scaled via programming to account for measured, non-nominal $C_{OX}$.

Figure 4:
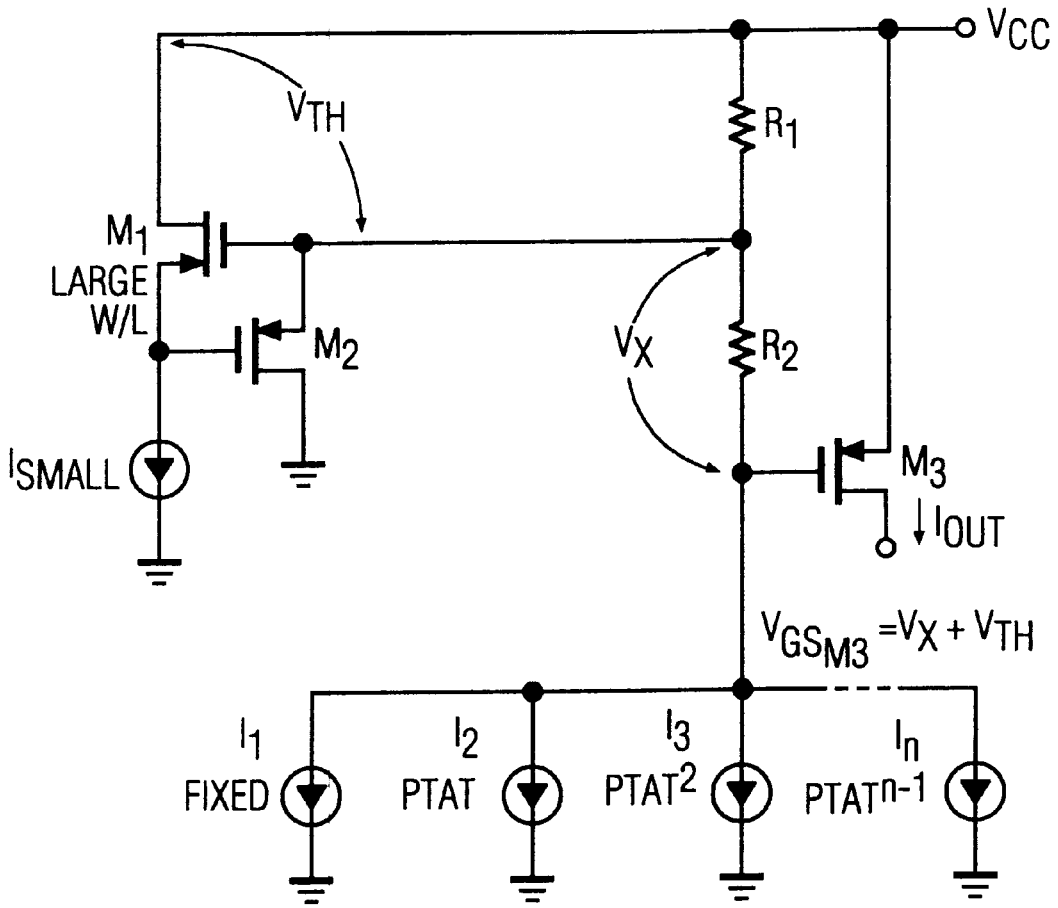
FIG. 4 shows the FIG. 3 circuit in more detail and in which the gate voltage $V_X+V_{TH}$ is generated so as to make the output current temperature invariant.

The circuit in FIG. 3 thus requires a bias voltage $V_X$ that has either approximately $T^{3/2}$ absolute temperature variation (for constant resistance) or else a temperature variation of approximately $T^{3/4}$ (for a constant current). FIG. 4 is a generalized circuit representation illustrating functionally how a circuit may be implemented which produces either one of these bias voltages (or for that matter any other desired arbitrary bias voltage temperature dependence characteristic). In FIG. 4, current sources $I_1$ through $I_n$ are shown. Current source $I_1$ is a constant current source that does not vary with temperature. Current source $I_2$ is a current source that is proportional to absolute temperature (known as PTAT). Current source $I_3$ is a current source which is proportional to absolute temperature squared ($PTAT^2$) Current source $I_n$ is a current source which is proportional to absolute temperature to the n−1 power ($PTAT^{n-1}$). As will become more apparent as this description proceeds, the value of n may vary from 2 upwards to whatever number is required to produce a desired $V_{GS}$ temperature characteristic of an arbitrary accuracy. In general, values of n between 2 and 4 should provide reasonable accuracy. Furthermore, one or more of the PTAT current sources in a series might have a value so low that a suitable circuit may be designed with acceptable accuracy without actually implementing one or more of the small PTAT terms in the series.

As will become more apparent in connection with later description of practical circuits, each of these current sources is actually implemented by creating a corresponding voltage source ($V_1$ for $I_1$; $V_2$ for $I_2$; etc.) having the right temperature characteristic (i.e., invariant for $V_1$; PTAT for $V_2$; $PTAT^2$ for $I_3$; $PTAT^3$ for $I_4$; etc.) and applying the voltage source across a resistance. The temperature characteristic of the resistances used to implement the current sources and the temperature characteristic of the R2 resistance are the same in the same integrated circuit. Therefore, each one of the voltage sources $V_1$ to $V_n$ produces a voltage component contribution to the total voltage $V_X$ that is equal to a resistor ratio times the value of the voltage source used to implement that current source. Since resistor ratios determine the coefficients of each component of $V_X$, temperature dependence of the resistances has no effect. If for each component portion of $V_X$, we let $K_i$ be the amplitude and $T^{i-1}$ be the temperature dependency, $V_X$ becomes $$V_X = \sum_{i=1}^{n} K_i T^{i-1}$$

which more closely resembles the form in which $V_X$ is actually implemented in the preferred embodiments.

Still referring to FIG. 4, the current-source PMOS, $M_3$, and the threshold-cancelling device, $M_1$, are operated with a common source-voltage for improved matching and elimination of body effect. No amplifiers are needed as well because $M_2$ provides feedback from the drain of $M_1$ to the gate of $M_1$, thereby providing a low-impedance output for $V_{TH}$ and yielding a smaller, more-accurate circuit. A small current flows through large device $M_1$, forcing its $V_{GS}$ to approximately its threshold value $V_{TH}$. The key design decision is determining the proper ratio of the various current sources $I_1$ to $I_n$ (or more accurately the voltage sources $V_1$ to $V_n$ that implement these current sources) to best match the mobility temperature drift of $M_3$.

Figure 5:
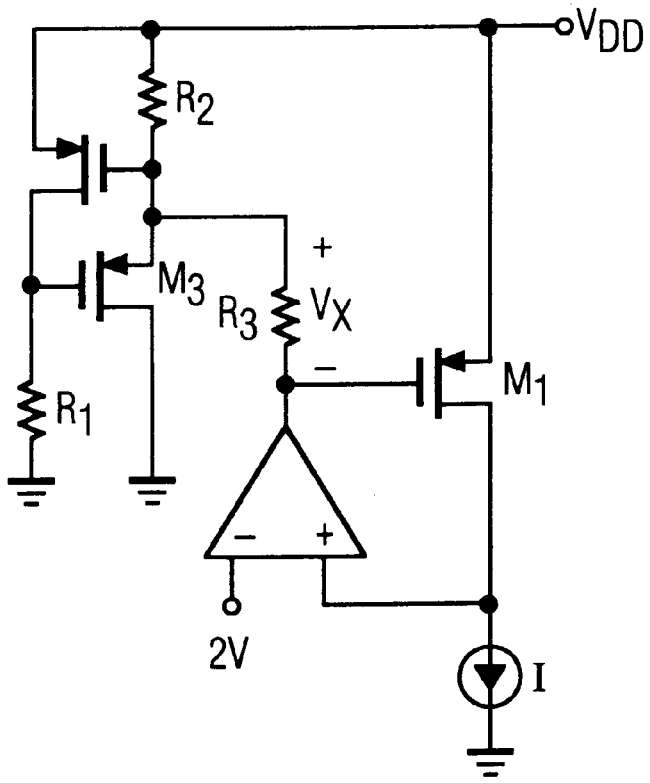
FIG. 5 is a circuit for use in experimentally determining proportionality factors for the PTAT sources in FIG. 4.
Figure 6:
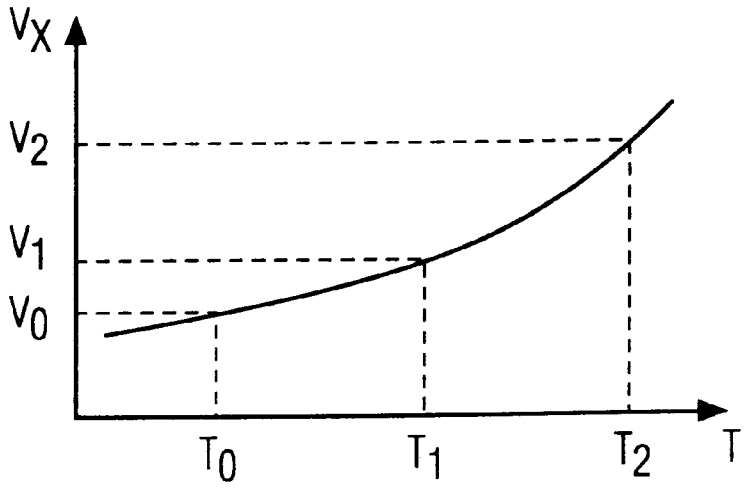
FIG. 6 is an example curve of $V_X$ as a function of temperature determined using the circuit of FIG. 5.

FIG. 5 shows a circuit that may be used to experimentally determine the right proportions for the current (or voltage) source terms. An opamp drives the gate of M1 to the gate-source voltage necessary for a drain current equal to a desired fixed current load I. We assume here that we want to determine the $V_X$ curve which makes $I_{OUT}$ of $M_3$ (FIG. 4) constant. I is selected to have the amplitude desired for $I_{OUT}$. If a temperature dependence is desired for $I_{OUT}$, I (in FIG. 5) is given this dependence! Large device M2 operates at low current to make $V_{GS}$ equal to the threshold voltage. The temperature T of the circuit is then swept over the range of interest (also varying I with the temperature dependence of $I_{OUT}$ if a temperature dependence is desired for $I_{OUT}$) and $V_X$ is measured as a function of temperature. FIG. 6 shows a curve which might be obtained using this method and three points on this curve at temperatures $T_0$, $T_1$ and $T_2$ with corresponding voltage values $V_0$, $V_1$ and $V_2$. The design task then becomes one of synthesizing this experimentally determined curve with the various temperature dependent sources. $V_X$ as a function of temperature can be defined as $$V_X(T) = k_1 + k_2\frac{T}{T_0} + k_3\left(\frac{T}{T_0}\right)^2 + \ldots k_n\left(\frac{T}{T_0}\right)^{n-1}$$

where $k_1$ is a temperature independent term, $k_2$ is the amplitude of a PTAT term, $k_3$ is the amplitude of a $PTAT^2$ term, and $k_n$ is the amplitude of a $PTAT^{n-1}$ term. If a straight-line approximation is good enough, then only the first two terms are needed and simultaneous equations can be solved using the values of $V_X$ at $T_0$ and $T_1$. A more exact approximation can be done by developing three simultaneous equations using the values of $V_X$ at $T_0$, $T_1$, and $T_2$. Four (or more) voltage values may be used to solve four (or more) simultaneous equations in the same way.

Figure 7:
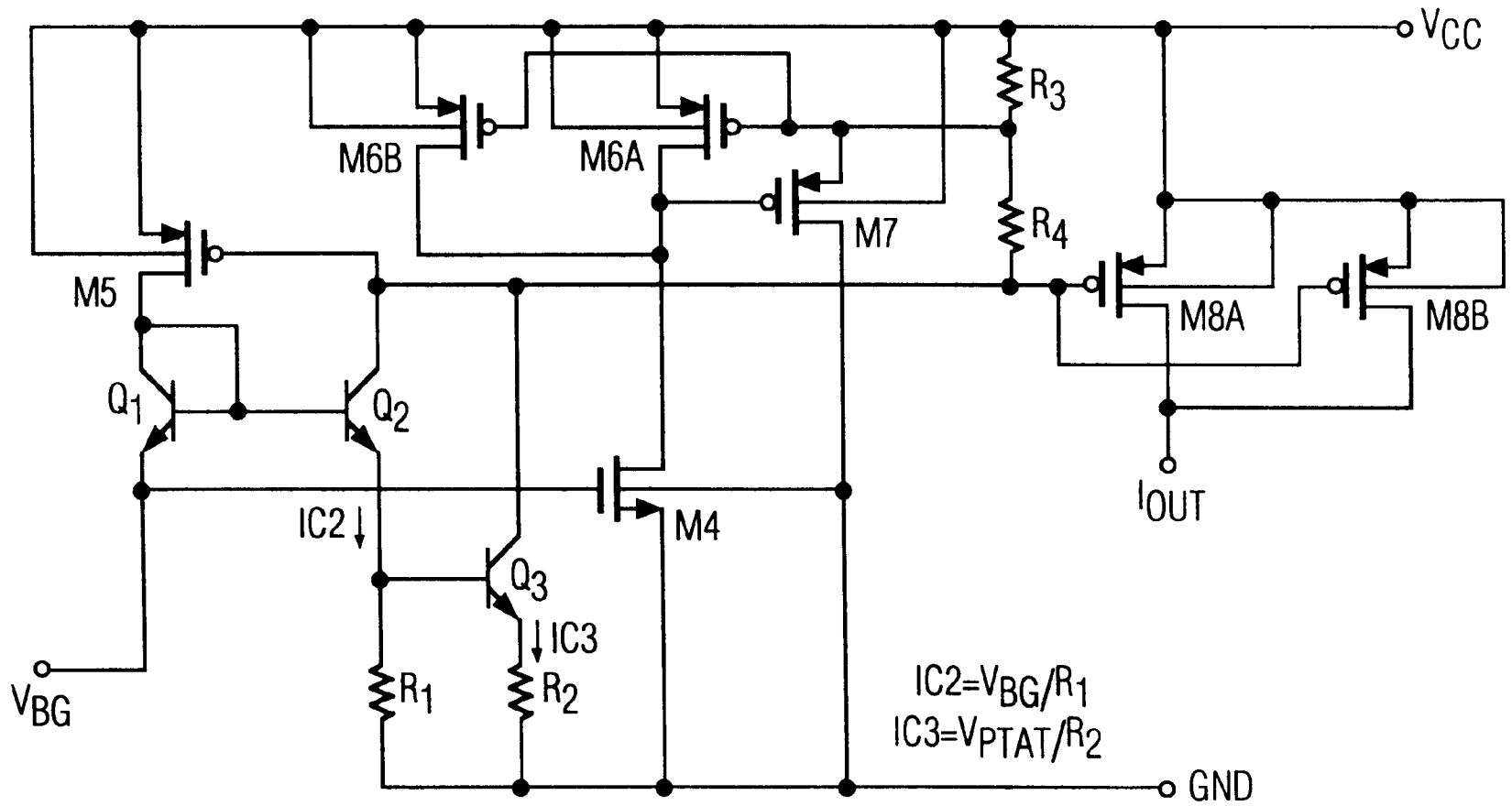
FIG. 7 is a circuit which converts a bandgap voltage reference into a constant current reference using the present invention.

Once the synthesis terms are known, the actual circuit is simple to implement, especially if a temperature invariant voltage reference is already available somewhere else in the design. FIG. 7 is a circuit which may be used to convert a bandgap voltage reference $V_{BG}$ into a constant current reference $I_{OUT}$. Going up a $V_{be}$ at $Q_1$ and down a $V_{be}$ at $Q_2$, the base voltage of $Q_3$ is also equal to $V_{BG}$. Therefore, the collector current IC2 of $Q_2$ is approximately $V_{BG}/R_1$. Since the emitter voltage of $Q_3$ is $V_{BG}$-$V_{be}$, the collector current IC3 of $Q_3$ will be PTAT. These two currents IC2 and IC3 are combined in $R_4$ to provide the bias voltage $V_X$. M5 is also biased for constant current, so the $Q_1$ and $Q_2$ base emitter voltages nearly track over temperature. Long channel device M4 provides a low current for the large threshold cancelling device M6. Both M6 and the current source device M8 are split in half to allow common centroid layout of these critical components.

The FIG. 7 circuit was built on a test mask in a 200 Angstrom gate process. The cancellation of mobility drift resulted in a variation in $I_{OUT}$ of only +/− 1.3% from −40 to 120 degrees C.

Figure 8:
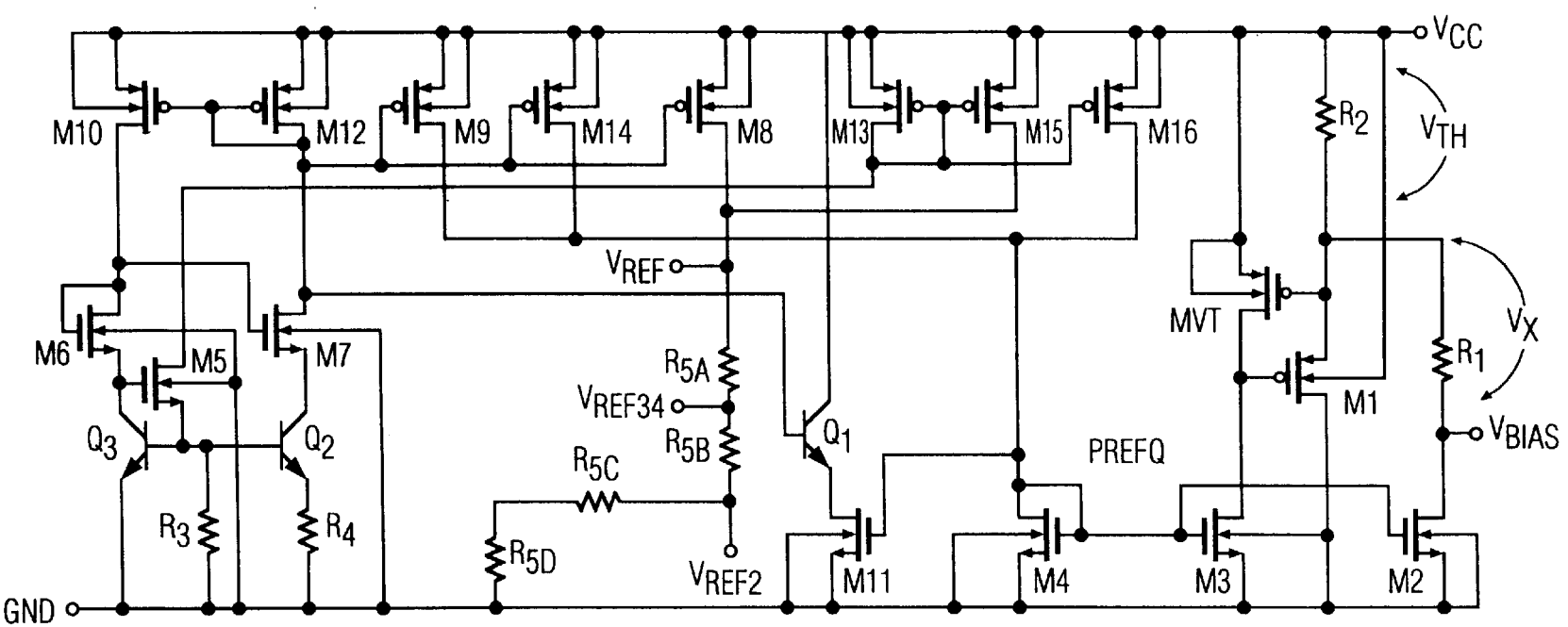
FIG. 8 is a generalized bias circuit for providing $V_X+V_{TH}$ in accordance with this invention.

FIG. 8 is a more generalized bias circuit designed to operate in multiple applications. This circuit provides both a temperature stable voltage reference, $V_{REF}$, and the bias for a temperature stable current reference, $V_{BIAS}$. Positive tc (temperature coefficient) current is derived with a conventional PTAT generator consisting of Q3, Q2, R4, and the M12-M10 mirror. In addition to biasing the bases of Q2 and Q3, M5 provides a negative tc current with a value of $V_{be}$ of Q3 divided by R3. These currents are combined in different proportions to get $V_{REF}$ and $V_X$. PMOS transistor MVT operates at low current for $V_{GS}$ equal to $V_{TH}$, and Q1 has been added to provide NPN base current compensation. Note that this circuit doesn't have second order correction, which could have been added with a translinear multiplier operating on the PTAT current to get a $PTAT^2$ current. $V_{REF}$ is set at 2 V, with taps at 1.5 V and 1 V available for various applications. This circuit will now be used in a circuit applications, in which this FIG. 8 reference circuit is labelled "PREFQ".

Figure 9:
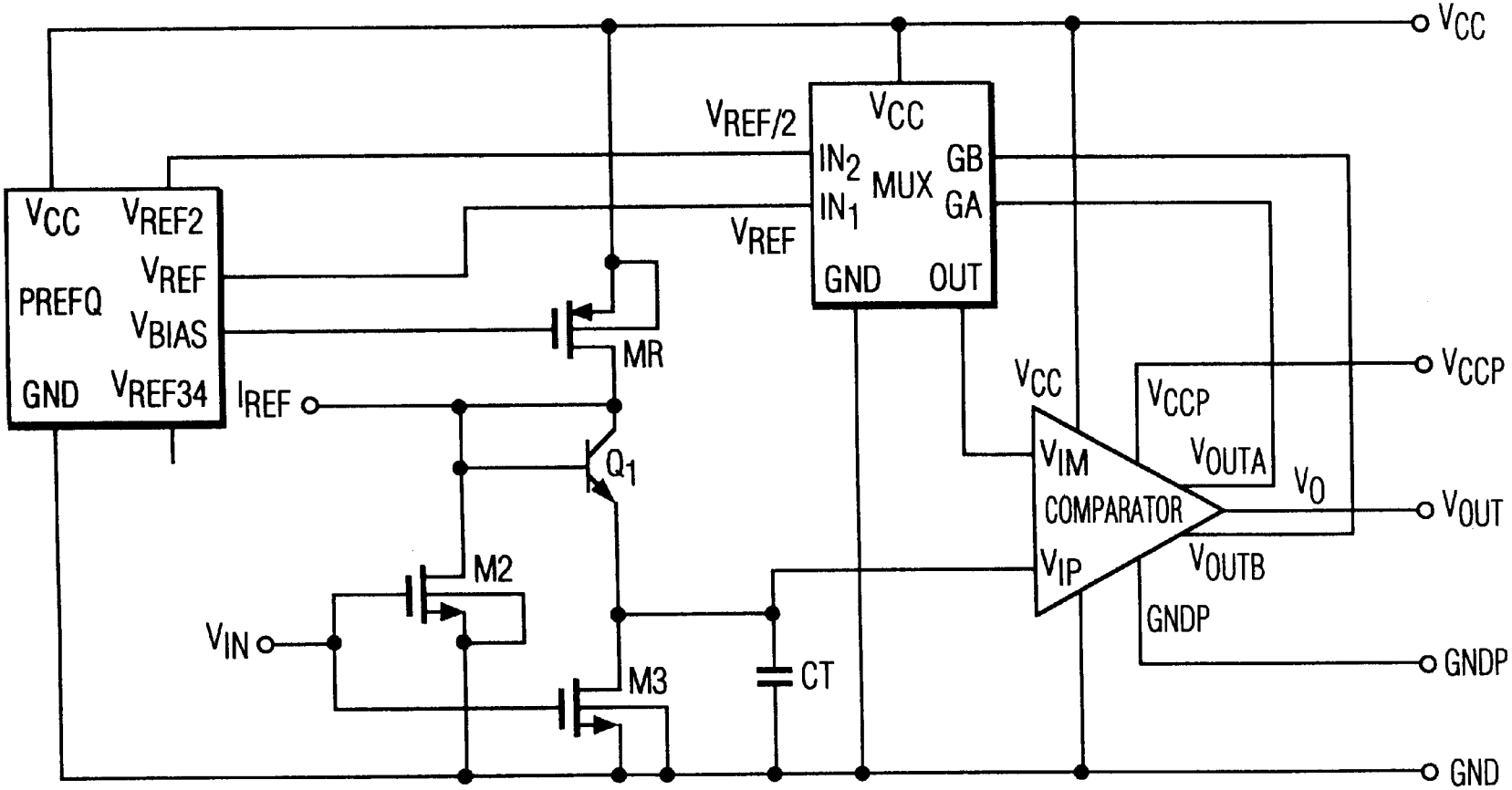
FIG. 9 is a oneshot circuit that uses the FIG. 8 circuit to bias an MOS FET for constant current operation that is invariant to temperature.

FIG. 9 is a oneshot circuit that uses the reference circuit PREFQ to bias PMOS MR for constant current. With $V_{IN}$ high, capacitor CT is held at zero volts. When $V_{IN}$ goes low, the constant drain current of MR ramps the voltage on CT. The reference circuit PREFQ also provides a 2 volt reference at the comparator negative input. When the ramp reaches this level, the output switches, and hysteresis is applied by switching the comparator negative input to a 1 volt reference. In the off state with $V_{IN}$ high, the drain of M2 is held low. Diode $Q_1$ is off, so no current flows through ramp reset switch M3. This resets the voltage on CT to zero without the need for a large device, minimizing loading of the timing capacitor and glitching due to feedthrough of the input voltage.

Figure 10:
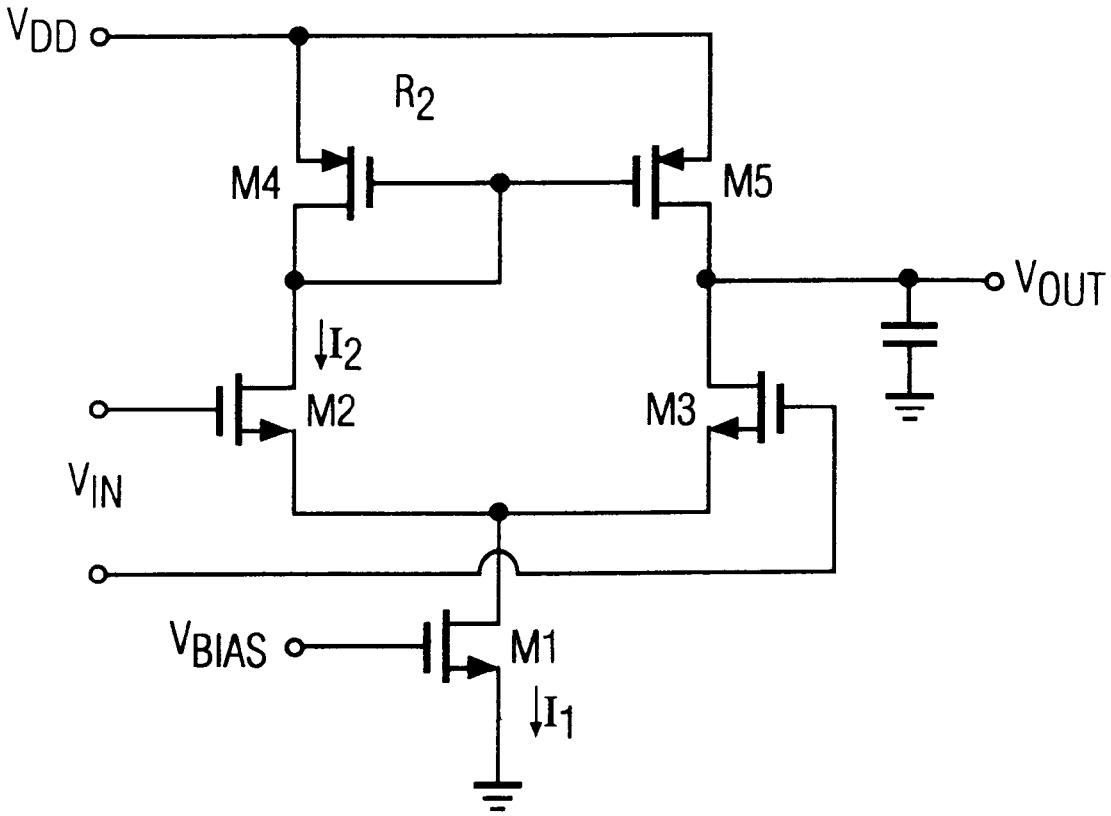
FIG. 10 PRIOR ART
FIG. 10 is a prior art Gm/C filter stage in which transconductance may be controlled by controlling the bias voltage of an FET current source using the present invention.

Another application of this invention is for transconductance control, which is especially useful for filtering. FIG. 10 shows a prior art Gm/C filter stage. For this simple Gm/C stage, the transconductance of the input device M2 is $$Gm_2 = \sqrt{2\mu C_{OX}\left(\frac{W}{L}\right)I_2}$$

Letting the the gate-source voltage of $M_1$ be $V_X$+$V_{TH}$, the transconductance turns out to be $$Gm_2 = \mu C_{OX} V_X K$$

where K is a constant set by the device areas. Designing $V_X$ for approximately a $T^{3/2}$ dependence will therefore yield temperature invariant filtering.

What has been described is how a mobility reference can provide a temperature invariant current source proportional to $C_{OX}$, or with a different tc a transconductance proportional to $C_{OX}$. These components can be combined with capacitors to build temperature stable oscillators, delay blocks, or filters, without the need for external components or trimming. While the specific circuits described use BICMOS technology, the fact that bandgap references are built in CMOS shows that the same principles can be applied there. It should also be possible to use parasitic MOS devices available in many bipolar processes to build time references. Although various embodiments of the present invention have been shown and described in detail, many other embodiments that incorporate the teachings of this invention may be easily constructed by those skilled in this art. Furthermore, modifications, improvements and variations upon any of these embodiments would be readily apparent to those of ordinary skill and may be made without departing from the spirit and scope of this invention. For example, whereever PMOS transistors are used, NMOS transistors could be used instead by substituting $V_{CC}$ for ground and ground for $V_{CC}$ and by reversing the directions of current sources and polarities of voltage sources.

What is claimed is:

1. A circuit for producing an output reference current having an arbitrary predetermined temperature dependence, comprising:

a first field effect transistor (FET) having a gate, a source, and a drain;

a second field effect transistor having a gate, a source, and a drain, said first FET source and said second FET source being commonly connected, said first FET having a threshold voltage, a bias source, operably coupled to the drain, gate and source of the second FET, that forces the voltage between the gate and the source of the second FET to be substantially equal to the threshold voltage of the first FET; and a temperature dependent current source that provides a temperature dependent current through a first resistor to produce a temperature dependent voltage;

the gate of the first FET being operably coupled to the gate of the second FET through the first resistor so that the voltage between the gate and the source of the first FET is equal to a sum of the second FET's gate to source voltage plus the temperature dependent voltage, and producing the output reference current at the drain of the first FET, a second resistor coupled between the first resistor and the sources of the first and second FETs, said temperature dependent current source including:

a first current source which is substantially independent of temperature variation and has a first current value determined by a first scaling factor of arbitrary value, and a second current source which is substantially proportional to absolute temperature and has a second current value determined by a second scaling factor of arbitrary value.

2. A circuit as claimed in claim 1, wherein said first and second FETs are PMOS transistors and wherein the sources of the first and second FETs are both connected to a common supply voltage.

3. A circuit as defined in claim 1, wherein said less source further comprises feedback means coupled between the drain of said second FET to the gate of said second FET for providing a low output impedance characteristic.

4. A circuit as defined in claim 1, wherein said further comprises a first and second current sources and third resistor, respectively and wherein said first and second scaling factors are determined by ratios of resistor values of said resistors.

5. A circuit as defined in claim 1, wherein said temperature dependent current source further includes a third current source.

6. A circuit according to claim 1, wherein said bias source includes a current source coupled to said drain of said second FET and a feedback transistor coupled between the gate and drain of said second FET.

7. A circuit according to claim 1, wherein said first and second current sources each include a respective voltage source coupled across a respective resistive device.

8. A circuit as defined in claim 5, wherein said third current source has a third current value that is substantially proportional to absolute temperature squared and has a value determined by a third scaling factor of arbitrary value.

9. A circuit according to claim 8, wherein said third current source includes a further voltage source coupled across a further resistive device.

10. A circuit for producing an output reference current having an arbitrary predetermined temperature dependence, comprising:

a first field effect transistor (FET) having a gate, a source, and a drain;

a second field effect transistor having a gate, a source, and a drain, said first FET source and said second FET source being commonly connected, a bias source, operably coupled to the drain, gate and source of the second FET, that forces the voltage between the gate and the source of the second FET to be substantially equal to the threshold voltage; and a temperature dependent current source that provides a temperature dependent current through a first resistor to produce a temperature dependent voltage, the temperature dependent current source including a plurality of current source circuits each contributing a portion "i" the temperature dependent current, a second resistor coupled between the first resistor and the sources of the first and second FETs, the gate of the first FET being operably coupled to the gate of the second FET through the first resistor so that the voltage between the gate and the source of the first FET is equal to a sum of the second FET's gate to source voltage plus the temperature dependent voltage, and producing the output reference current at the drain of the first FET, said temperature dependent current being substantially equal to:

$$\epsilon_{i-1}{}^{n}M_iT^{i-1}$$

where $M_i$ is a predetermined amplitude of the ith portion of the temperature dependent current, T is absolute temperature and n is at least 2.

11. A circuit as claimed in claim 10, wherein said first and second FETs are PMOS transistors and wherein the sources of the first and second FETs are both connected to a common supply voltage.

12. A temperature dependent current source as defined in claim 10, wherein said circuit further comprises scaling resistors and wherein $M_i$ is determined by ratios of resistor values of said scaling resistors and said first resistor.

13. A circuit according to claim 10, wherein said bias source includes a current source coupled to said drain of said second FET and a feedback transistor coupled between the gate and drain of said second FET.

* * * * *